US005222764A

United States Patent [19]

Dyer

[11] Patent Number: 5,222,764

[45] Date of Patent: Jun. 29, 1993

[54] POCKET ORGANIZER SYSTEM

[76] Inventor: James W. Dyer, 6215 Ferris Square, #140, San Diego, Calif. 92121

[21] Appl. No.: 749,938

[22] Filed: Aug. 26, 1991

[51] Int. Cl.[5] ..... A44L 3/00

[52] U.S. Cl. ..... 281/45; 40/642; 150/147; 229/1.5 R; 281/42; 281/15.1

[58] Field of Search ..... 40/159, 642; 150/147; 229/1.5 R; 281/45, 42, 15.1

[56] References Cited

U.S. PATENT DOCUMENTS

| | | | |
|---|---|---|---|
| 680,350 | 8/1901 | Parmelee | 281/5 |
| 956,534 | 5/1910 | Lahey | 281/45 |
| 2,541,735 | 2/1951 | Albrecht, Jr. | 281/42 |
| 3,999,317 | 12/1976 | Owens | 40/642 X |
| 4,016,664 | 4/1977 | Kaufmann | 150/147 |

OTHER PUBLICATIONS

Day-Timers Catalog 1989-1990 pp. 9, 11, 12, 13 & 56, (Day-Timers Inc., Allentown PA).

*Primary Examiner*—Paul A. Bell

*Attorney, Agent, or Firm*—Brown, Martin, Haller & McClain

[57] ABSTRACT

An information organizing system includes a series of paper sheets which are each foldable along several fold lines into a folded sheet of pocket-size proportions. Each portion carries imprinted information, with at least some portions also having spaces for user entry of various types of information. A pocket-size rectangular wallet has a pair of outer walls and an inner pocket for holding several folded sheets. At least one wall has edge or corner pockets on its outer side for receiving the edges of a folded sheet to hold the sheet flat against the outside of the wallet.

18 Claims, 4 Drawing Sheets

POCKET ORGANIZER SYSTEM

BACKGROUND OF THE INVENTION

The present invention relates generally to a system for organizing paperwork such as daily, monthly and yearly calendars, notes, phone number lists, lists of things to do, and the like, and for conveniently carrying and storing such paperwork.

People generally use diaries, daily calendars and the like to keep records of appointments for meetings and the like, while they use separate, bulky notebooks or note pads to make notes of matters discussed in meetings, telephone conversations and the like, as well as tasks to be accomplished. This type of paperwork is typically bulky and difficult to organize or carry around conveniently when travelling or visiting customers, for example, and is easily lost.

SUMMARY OF THE INVENTION

It is an object of the present invention to provide a new and improved system for organizing and carrying paperwork such as weekly and monthly calendars, and lists of other important information.

According to the present invention, an organizer system is provided which comprises a generally pocket-sized holder or wallet, and a series of paper sheets carrying various types of imprinted information, each sheet being foldable into a pocket size for selectively fitting into the wallet. The sheets have spaces for the user to insert information such as appointments, things to be done, telephone number lists, and the like. The wallet or folded sheet holder has parallel outer walls defining a pocket for receiving several folded sheets, and a retainer device on the outside face of at least one wall for holding a folded sheet flat against the wall. In a preferred embodiment, the wallet comprises a pair of panels secured together along three side edges and open along the fourth edge to allow folded sheets to be inserted or removed, each panel having at least two pockets on its outer face positioned opposite one another on opposite edges of the panel for receiving opposite edges of a folded sheet to hold the folded sheet flat against the panel with information on the outer portion of the folded sheet exposed.

Preferably, the paper sheets include a weekly calendar for keeping track of appointments in any one week, a monthly calendar for more long term planning, a yearly calendar for keeping track of annual events and more long term plans, a phone list sheet for keeping records of telephone numbers and addresses, and a general note taker for making notes of things to be done and other important information such as notes of telephone conversations and items discussed in meetings.

Each sheet is hole punched for fitting in a suitable two or three ring binder when flat, and has a series of pre-formed fold lines for folding it into the pocket size dimensions for fitting into the wallet or holder. The sheet has a first, central fold line extending across its width to divide it into two halves, and each half has two fold lines extending transverse to the central fold line dividing that half into equal thirds. The fold lines on opposite halves are oppositely folded, so that when the sheet is folded along the central fold line with the two halves face to face, the additional fold lines in each half will be directed the same way to allow two more folds to be made to fold the sheet into a size equal to 1/6 of the full size. The fold lines therefore separate the sheet into six equal portions on each face of the sheet, and each portion carries a set of imprinted indicia along with spaces for the user to enter appropriate planning or other information.

For example, in the case of a weekly planning sheet, the six sections on one side will be imprinted with successive days of the week, the sixth panel section being imprinted with Saturday and Sunday, since fewer appointments are typically made on those days. Each section will also be imprinted with consecutive time slots for entry of daily appointments. The opposite side of the weekly planning sheet may include a calendar for the year or more than one year in one section, and sections with spaces for entering various information such as expenses, future appointments and the like.

In order to use the system, a person simply folds the weekly sheet so that the appropriate day is outermost, then places the folded sheet in the pockets on one outer face of the wallet. Another planning sheet, such as a note taking sheet, will be folded and placed on the opposite outer face of the wallet. Other sheets which may be needed during normal daily activities or business, such as a telephone list and monthly or yearly planning sheet, may be placed inside the wallet. The entire assembly then fits easily into a pocket, purse, wallet, checkbook or the like, and can be taken out and held in one hand while making any necessary notes or entries with the other hand. The wallet itself is sufficiently rigid to act as a rest when making notes on a folded sheet.

This system is compact, convenient and easy to use. It allows appointments and time to be tracked and recorded quickly and easily, and sheets can be stored together for future reference as appropriate. Since it is so easy to carry, it reduces the risk of being without essential information.

BRIEF DESCRIPTION OF THE DRAWINGS

The present invention will be better understood from the following detailed description of a preferred embodiment of the invention, taken in conjunction with the accompanying drawings, in which like reference numerals refer to like pairs, and in which.

DESCRIPTION OF THE PREFERRED EMBODIMENT

Figure 1:
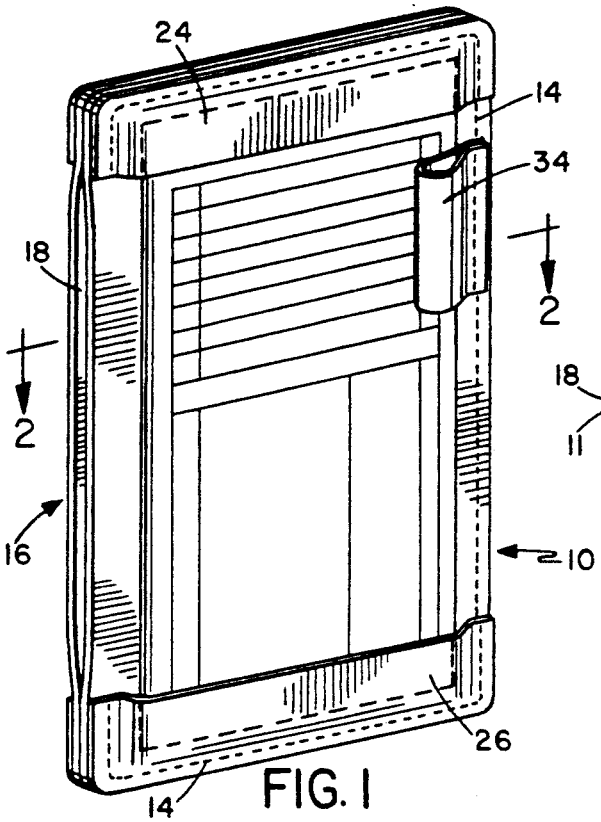
FIG. 1 is a perspective view of a wallet or holder for holding appointment or other information sheets in an organizing system according to a preferred embodiment of the invention.
Figure 2:
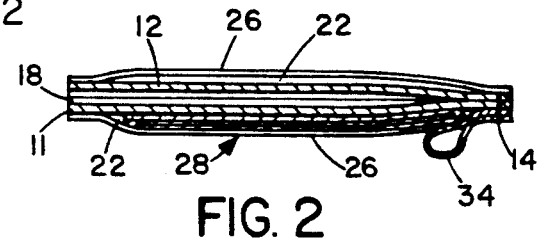
FIG. 2 is a section on the lines 2—2 of FIG. 1.

FIGS. 1 to 9 illustrate various parts of an organizing system according to a preferred embodiment of the present invention for making and keeping records of various types of information in a convenient manner. A first part of the system comprises a rectangular wallet or holder 10 of pocket-size dimensions, for example around 3 to 4 inches in width and 5 to 6 inches in height. The wallet comprises two flat panels 11, 12 of leather, plastic or similar semi-rigid materials which are sewn or otherwise secured together along three sides, for example by stitching lines 14, to leave one side 16 open for access to a pocket 18 between the two panels.

Figure 3:
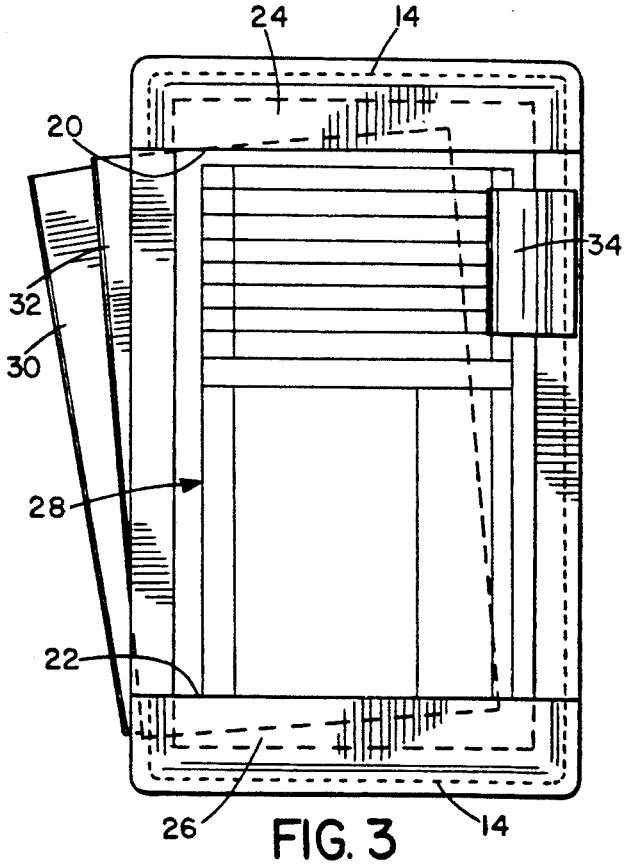
FIG. 3 is a front elevational view of the wallet of FIG. 1 holding several information or appointment sheets.

Each panel 11, 12 has a pair of small, edge pockets 20, 22 formed along opposite edges by strips 24, 26 of material secured along three edges to the panel via the same line of stitching 14 which secures the two panels together. The wallet 10 is designed to carry various folded paper sheets 28, 30, 32 as illustrated in FIG. 3, each of the sheets carrying various types of information organizing indicia on each of its faces, as will be explained in more detail below. The edge pockets 20, 22 on the outer face of each panel 11, 12 are designed to receive the edges of a folded sheet, for example sheet 28 as illustrated in FIG. 3, so that the sheet is held flat against the panel with the imprinted information exposed. Two different sheets can therefore be held on opposite faces of the wallet for easy access and entry of information. The inner pocket 18 between the panels is designed to hold various other folded sheets, such as sheets 30 and 32 as illustrated in FIG. 3, for carrying various types of information as selected by the user. A loop 34 of material for carrying a pencil or pen is secured to one side edge of one of the panels 11 via stitching 14.

The size of the organizing system is such that it can be conveniently carried in a pocket, purse, checkbook or the like. This allows all of the paperwork needed by business people, salesmen, or other individuals to keep track of appointments, important dates, phone numbers and other information, to be carried together in a convenient, compact format.

Figure 5:
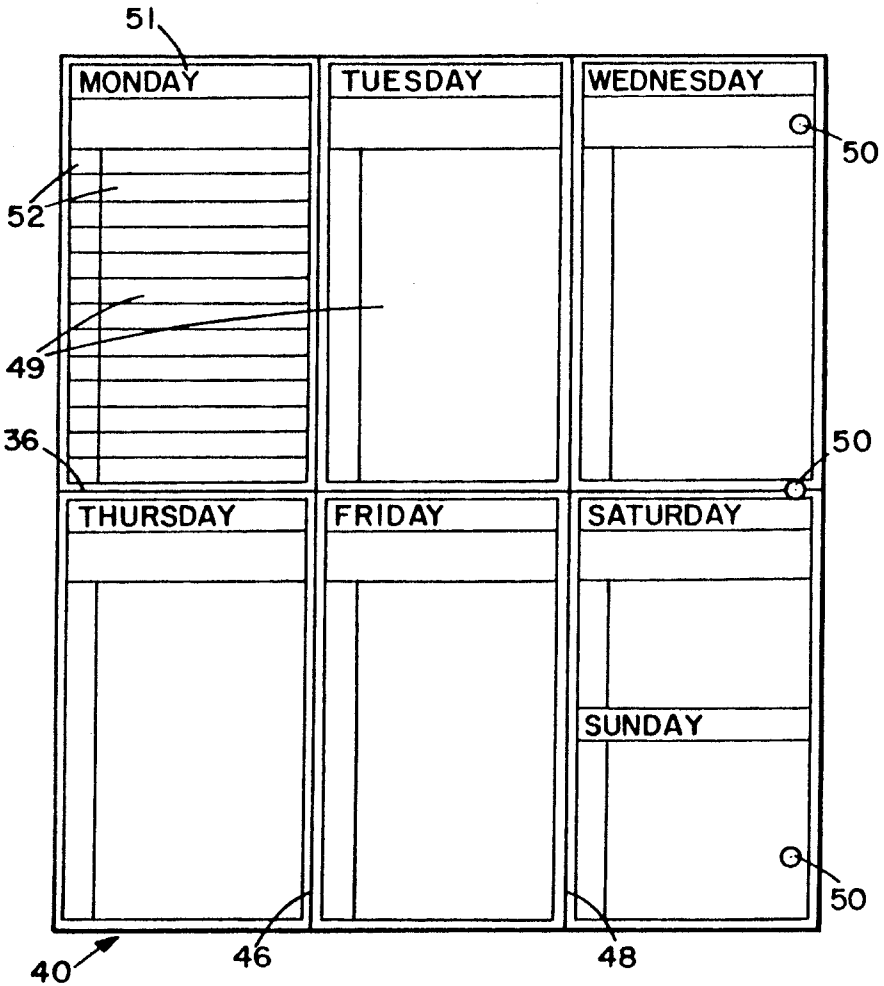
FIG. 5 is a top plan view of one side of the sheet of FIG. 4 when completely unfolded.

The various folded sheets for use in the system are designed to provide spaces for entry of various planning and other information. Each sheet is of standard folder size such as A-4 when unfolded into a flat condition as illustrated in FIG. 5, and has a first, central fold line 36 extending across its width separating it into two halves 38, 40. Each half is in turn divided into three equal sections 49 by fold lines 42 and 44, and 46 and 48, respectively, extending transverse to central fold line 36. Holes 50 are provided along one side edge of the unfolded sheet so that it can be placed in a storage binder of the two or three ring type for record keeping purposes when no longer in use on a daily basis.

Figure 6:
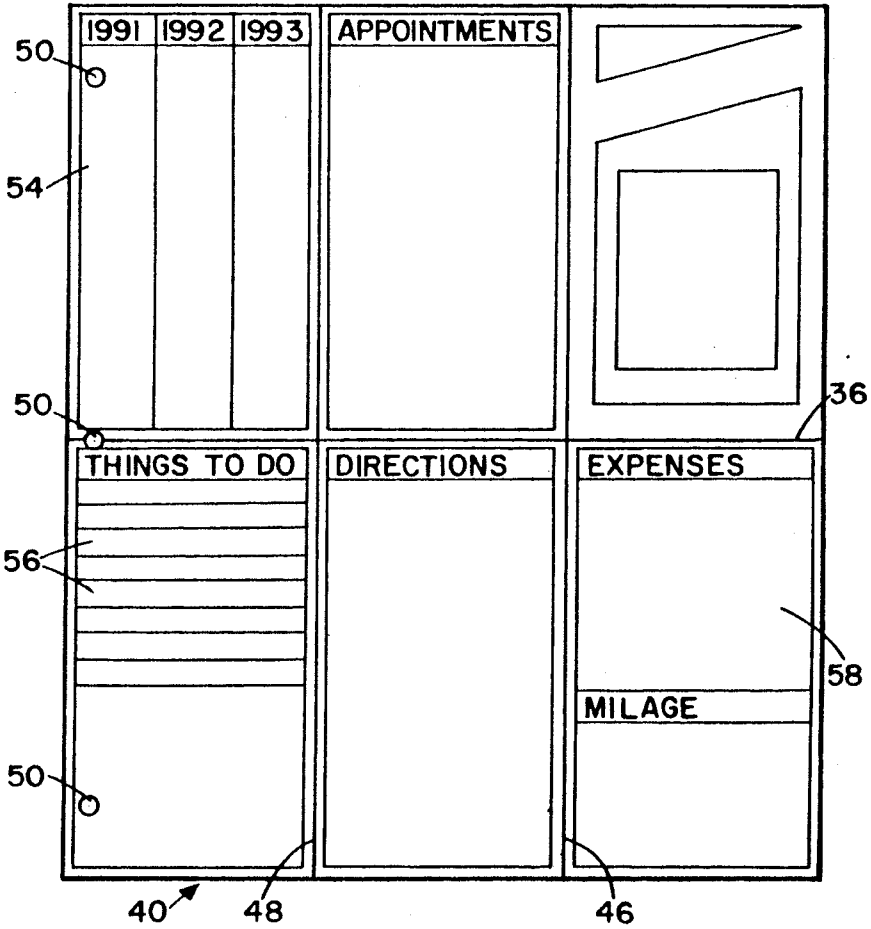
FIG. 6 is a plan view of the opposite side of the sheet of FIG. 5.

Each sheet will be designed for a particular record or information keeping purpose. For example, sheet 28 illustrated in FIGS. 5 and 6 is designed as a weekly calendar. On one side of the sheet 28, successive sections 49 in each half 38, 40 are imprinted with successive days 51 of the week, along with imprinted spaced lines forming spaces 52 for entering appointments and the like. On the opposite side of the sheet, the sections carry other imprinted information such as an annual date calendar 54, spaces 56 for making notes of things to do, space 55 for entering appointments for successive weeks, spaces for keeping expense information 58, and so on.

Figure 4:
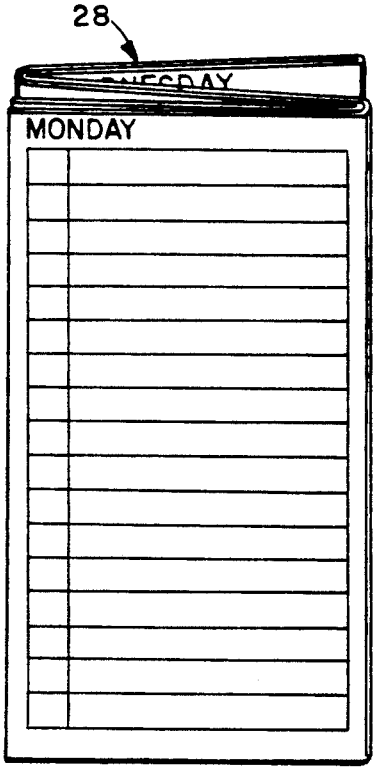
FIG. 4 is a perspective view of one of the sheets of the system partially unfolded.
Figure 7:
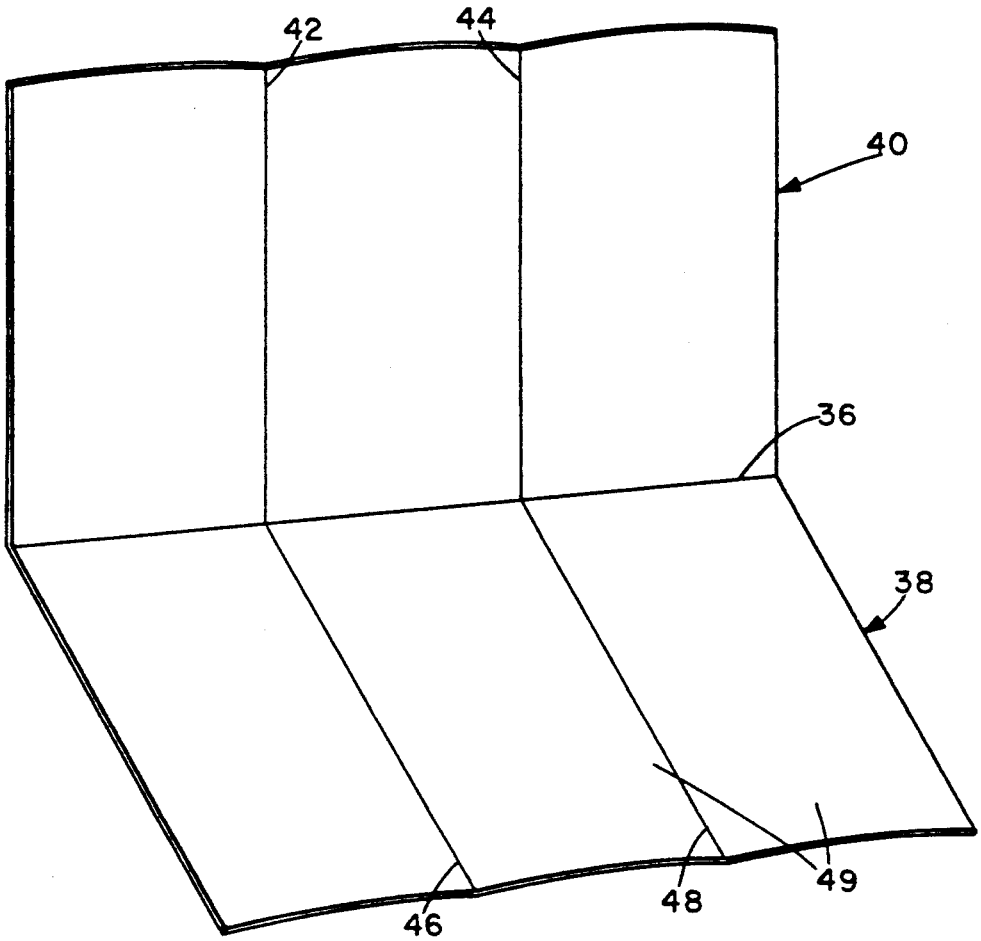
FIGS. 7 and 8 are views illustrating successive stages in the folding, of a sheet between the fully unfolded position of FIGS 5 and 6 and the folded position of FIG. 4.
Figure 8:
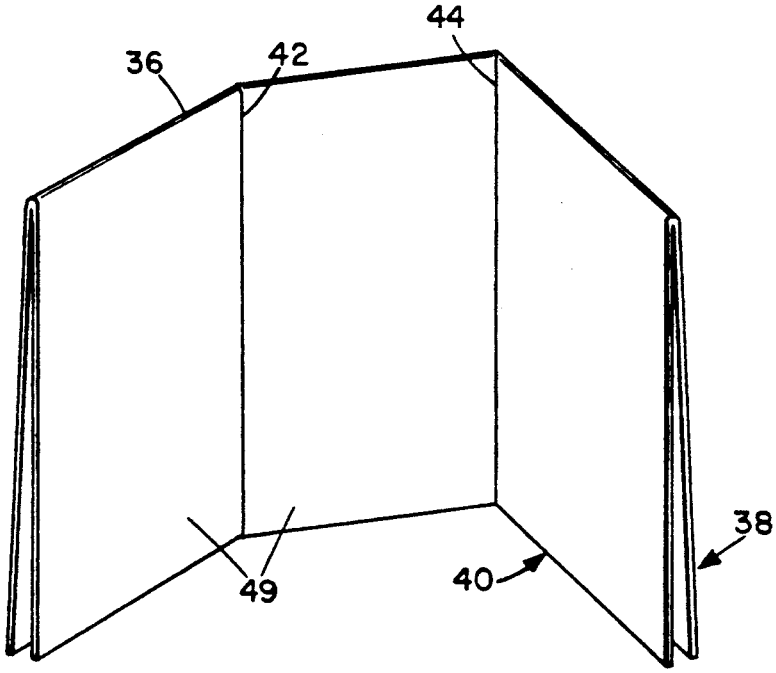

FIGS. 7 and 8 illustrate how any of the sheets in the system may be folded between the flat condition of FIGS. 5 and 6 and the folded condition of FIG. 4. The sheet is first folded in half along central fold line 36. The transverse fold lines 42 and 44 in one half of the sheet are creased in the opposite direction to the fold lines 46 and 48 in the other half, so that when the sheet is folded along line 36, the fold lines 42 and 46, and 44, 48, respectively, will overlie one another and face the same way. The sheet is then folded twice more, along lines 42, 46 and lines 44, 48, so that the desired section 49 is outermost, for example as illustrated in FIG. 4. The sheet can be folded to expose any desired section 49. The folded sheet is of pocket-size dimensions, preferably of around 3 inches by 5 inches, and fits into the outer, edge pockets 20, 22 on one side of wallet 10 so that the current day faces outward and any appointments entered are easily visible, and other information can be entered as needed. The wallet fits easily into one hand and is rigid enough to act as a rest while the user is entering information.

On the next day, the user simply takes out the folded sheet, re-folds it so that the next day faces outward, and re-places it into the pockets 20 and 22 so that appointments are immediately visible and other plans can be entered easily when appropriate.

Figure 9:
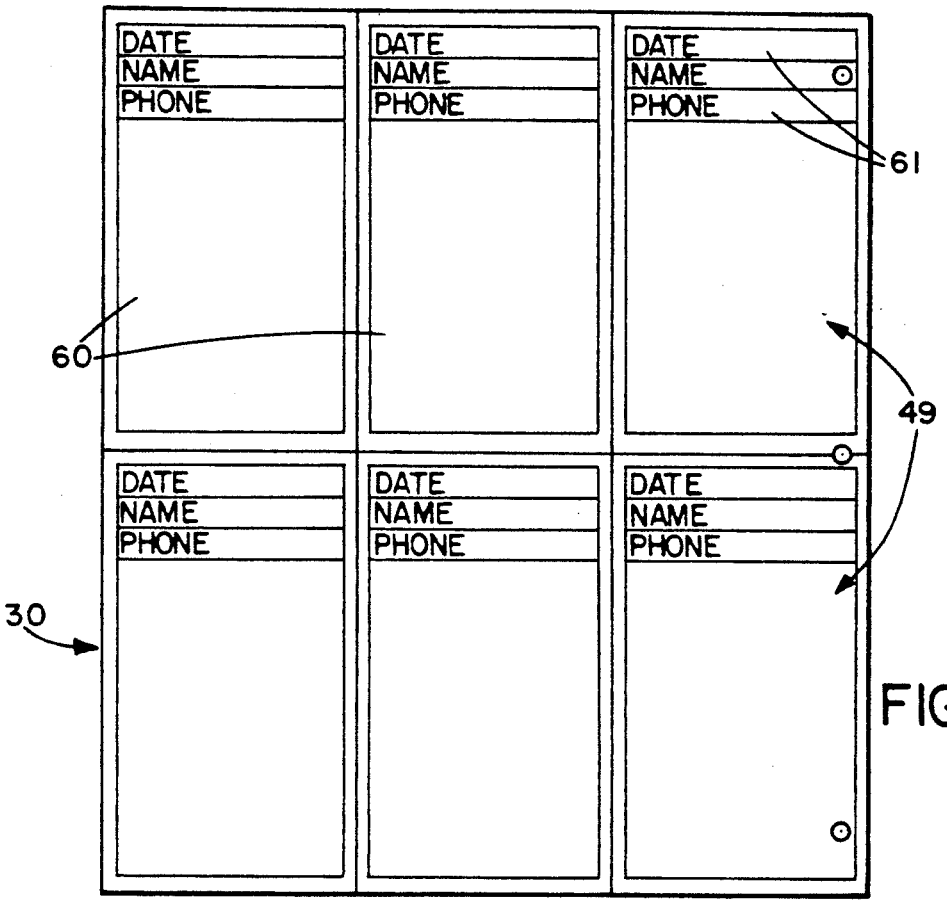
FIG. 9 is a plan view of a second type of sheet of the system.

The additional folded sheets which will normally be carried in wallet 10 will include an annual calendar sheet, with sections carrying twelve monthly calendars, two per section, on one side, along with spaces for entering important dates and long term planned appointments. This will typically be carried inside the wallet for reference when needed. The opposite side of the annual calendar may carry subsequent year calendars, important phone numbers, and other essential information. Another type of sheet which can be carried is a note taking sheet 30 as illustrated in FIG. 9. Most or all of the sections 49 in this sheet simply carry spaces 60 which may be lined for taking notes, for example during meetings or telephone conversations. The note taking sheet 30 will typically be carried on the opposite side of the wallet to the weekly calendar sheet 28, with its opposite ends retained in pockets 20 and 22 on that side of the wallet so that notes can be made easily as needed, for example during meetings. Each portion 49 of this sheet includes spaces 61 at the top for entering identifying information, such as the date, name, phone number and subject, to allow information on important conversations to be recorded easily. All of the sheets fold in the same way as described above, with the fold lines separating them into twelve equal sections for carrying various types of imprinted information and spaces for entering information.

Other types of planning and information carrying sheets which may be provided in the system include a phone list sheet, having spaces in each section for entering telephone numbers and addresses, with letters arranged in alphabetical sequence from section to section, a sheet carrying a things to do list in some or all of the divided sections, a monthly calendar, a travel schedule, automobile log sheets, exercise log sheets, shopping list sheets with lists of commonly purchased items, and so on.

Figure 10:
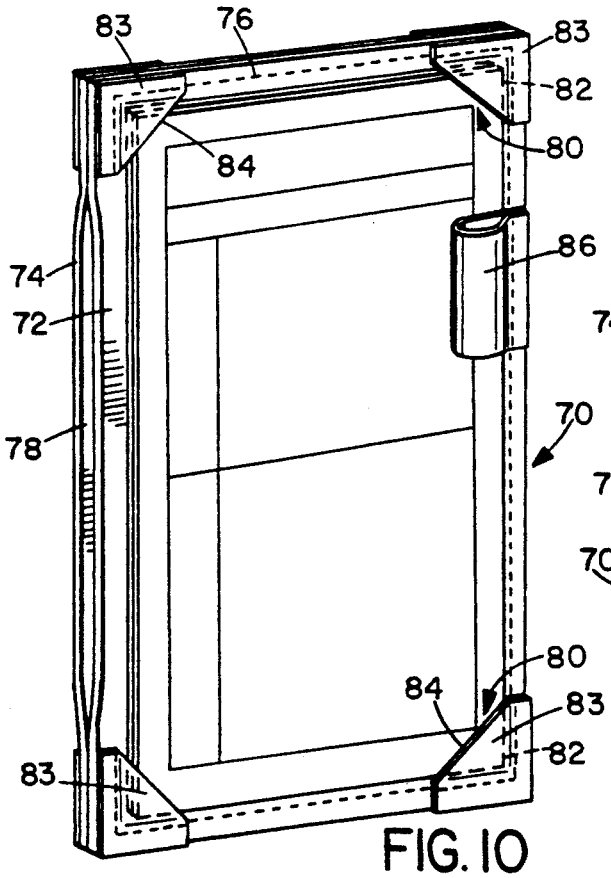
FIG. 10 is a perspective view illustrating a modified wallet for carrying folded sheets.
Figure 11:
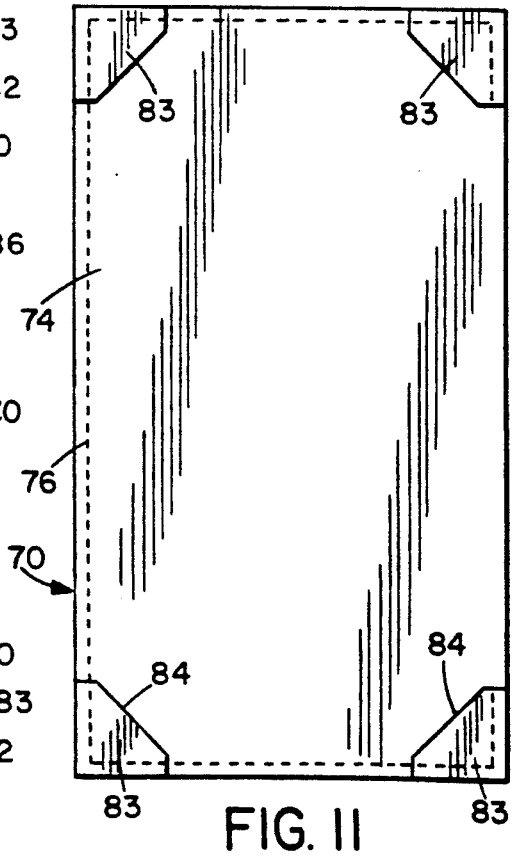
FIG. 11 is a plan view of the opposite side of the wallet of FIG. 10.

FIGS. 10 and 11 illustrate a modified wallet 70 for carrying the folded sheets. As in the previous embodiment, the wallet 70 comprises a pair of flat panels 72, 74 sewn together on three sides via stitching 76 to form an inner pocket 78 for receiving folded sheets. However, each panel has four corner pockets 80 on its outer face for receiving the respective corners 82 of a folded sheet, as illustrated in the drawings. Each corner pocket is formed by a triangular sheet of material 83 sewn to a respective corner of the wallet via stitching 76 along two of its edges, with diagonal edge 84 left open to receive the corner 82. This allows folded sheets to be inserted and removed easily. Wallet 70 also has a loop 86 of material sewn in at one side edge for carrying a pen or pencil.

This record keeping, time management and tracking system allows information on daily appointments, yearly events and meetings, things to do, and other important matters to be entered in a convenient manner and stored in a pocket-sized wallet to be handy at all times. The system reduces the risk of important information being lost, since instead of making notes on various different scraps of paper which are easily mislaid, the user can enter all types of information on the set of folded sheets and hold the sheets in one easy-to-use wallet. When or if the information is no longer needed on a day-to-day basis, a folded sheet can be removed from the wallet, opened out, and inserted in a binder or file for record keeping purposes. Folded sheets carried on the outside of the wallet are easily visible and can be used for entering notes on meetings, telephone conversations, and so on. When an exposed portion is completed, an outer folded sheet is simply removed, and turned or re-folded to expose the next section or next day of a weekly calendar, before replacing it in the holder.

This time and information organization system is inexpensive, compact, and easy to use, and allows scheduling, planning and note taking to be done easily, and to be readily available for subsequent review.

Although a preferred embodiment of the invention has been described above by way of example only, it will be understood by those skilled in the field that modifications may be made to the disclosed embodiment without departing from the scope of the invention, which is defined by the appended claims.

I claim:

1. An information organizing system, comprising:

a multi-ring folder for holding paper sheets of standard writing paper size;

a series of paper sheets of predetermined unfolded dimensions for fitting into said multi-ring folder, each sheet having holes punched adjacent one edge for fitting within the multi-ring folder when unfolded, and a plurality of fold lines separating the sheet into a series of pocket-size portions of dimensions of the order of 3 inches by 5 inches, at least one of the fold lines extending perpendicular to the other fold lines, and each sheet being foldable about the fold lines into a pocket-size folded sheet with any selected portion facing outward;

each portion of each sheet carrying imprinted information within an area spaced inwardly from the adjacent fold lines separating that portion from the adjacent portions, the imprinted information on at least some portions of each sheet including spaces for user entry of selected information; and a pocket-size, flat rectangular wallet of predetermined dimensions for fitting into a user's pocket, the wallet having parallel outer walls and at least one internal pocket between the walls for receiving one or more of the folded sheets, at least one of the outer walls having a retainer device for retaining opposite edges of a selected folded sheet to hold the sheet flat against the outside of the wallet with a selected portion of the sheet facing outward.

2. A method of organizing information, comprising the steps of:

placing a plurality of foldable sheets into a pocket-size into a pocket-size, flat rectangular wallet with at least one of the folded sheets retained on the outside of the wallet with a selected one of its folded portions facing outward, the folded portion carrying imprinted indicia including spaces for user entry of selected information;

entering selected information in the spaces on the outwardly facing folded portion;

when all desired information has been entered in the outwardly facing folded portion of the outer sheet, re-folding the sheet so that another folded portion faces outward, the other portion also carrying imprinted indicia including spaces for user entry of selected information;

repeating the procedure of entering selected information and re-folding the sheet until all folded portions having spaces for user entry of information have been used;

removing the completed sheet from the pocket-size wallet;

unfolding the sheet and placing it into a multi-ring binder of dimensions matching those of the unfolded sheet;

folding a new sheet and placing it with a selected folded portion facing outward into the pocket-size wallet; and repeating the procedure for entering information on each folded sheet and placing the successive completed sheets into the multi-ring storage binder.

3. An information organizing system, comprising:

a series of paper sheets of predetermined dimensions for fitting into a standard size paper holding folder, each sheet having a plurality of fold lines separating the sheet into a series of pocket-size portions, at least one of the fold lines extending perpendicular to the other fold lines, each sheet being foldable about the fold lines into a pocket-size folded sheet with any selected portion facing outward;

each pocket-size portion of the sheet carrying a section of imprinted information and the imprinted information on at least some of the portions including spaces for user entry of selected information, each section of imprinted information being spaced within the adjacent fold lines and separated from all adjacent sections by the adjacent fold lines; and a pocket size, flat rectangular wallet for holding a plurality of folded sheets, the wallet having parallel outer walls and at least one internal pocket between the walls for receiving one or more of the folded sheets, at least one of the outer walls having a retainer device for retaining the opposite edges of a selected folded sheet to hold the sheet flat against the outside of the wallet with a selected portion of the sheet facing outward.

4. The system as claimed in claim 3, wherein each sheet carries a different set of information, one of said sheets comprising a weekly calendar, at least some of the portions of said weekly calendar carrying imprinted information representing successive days of the week and having spaces for entering appointments for selected days.

5. The system as claimed in claim 4, wherein another of said sheets comprises a yearly calendar and at least some portions of said yearly calendar carry imprinted information representing successive months of a year, and spaces for entering information on selected dates for each month.

6. The system as claimed in claim 4, wherein one of said sheets comprises a noter for taking notes, at least a majority of the portions of the noter carrying imprinted, spaced lines for entry of notes.

7. The system as claimed in claim 4, wherein one of said sheets comprises a phone list for entry of phone numbers, at least the majority of the portions of the phone list sheet carrying imprinted spaced lines, successive portions carrying one or more letters arranged in alphabetical sequence.

8. The system as claimed in claim 3, wherein the dimensions of each sheet when unfolded are of the order of 9 inches by 10 inches, and the fold lines divide each sheet into six equal size portions on each fact of the sheet.

9. The system as claimed in claim 3, wherein each sheet carries informational indicia on both of its faces.

10. The system as claimed in claim 3, wherein the wallet has a loop for holding a pen or pencil.

11. The system as claimed in claim 3, wherein the wallet comprises a pair of face-to-face, flat panels secured together along three edges and unsecured along the fourth edge to provide an opening for inserting and removing folded sheets.

12. The system as claimed in claim 3, wherein each outer wall has a retainer device on its outer face for releasably holding a selected folded sheet with a selected portion of the sheet facing outward.

13. The system as claimed in claim 3, wherein said retainer device comprises at least two outer edge pockets adjacent opposite edges of said one wall for receiving opposite edges of the folded sheet, the edge pockets being of predetermined dimensions for retaining the folded sheet edges while leaving the imprinted information exposed.

14. The system as claimed in claim 13, wherein each edge pocket has an opening extending parallel to the adjacent side edge of the wallet.

15. The system as claimed in claim 13, wherein said edge pockets comprise four corner pockets at the respective four corners of the wall for receiving respective corners of a folded sheet.

16. The system as claimed in claim 15, wherein the corner pockets are of triangular shape.

17. The system as claimed in claim 16, wherein each outer wall has four corner pockets on its outer face for retaining the respective four corners of a selected folded sheet.

18. The system as claimed in claim 3, wherein each sheet has holes punched adjacent one edge for fitting into a multi-ring folder when folded.

* * * * *